US005890040A

United States Patent [19]

Matsuoka et al.

[11] Patent Number: 5,890,040

[45] Date of Patent: Mar. 30, 1999

[54] DEVELOPER CARTRIDGE AND DEVELOPER REPLENISHING APPARATUS

[75] Inventors: Isao Matsuoka; Masahiro Shigetomi, both of Hachioji, Japan

[73] Assignee: Konica Corporation, Japan

[21] Appl. No.: 20,302

[22] Filed: Jan. 12, 1998

[30] Foreign Application Priority Data

Jan. 14, 1997 [JP] Japan ..... 9-004599
Jan. 14, 1997 [JP] Japan ..... 9-004600

[51] Int. Cl.[6] ..... G03G 15/08

[52] U.S. Cl. ..... 399/262; 222/DIG. 1; 399/263

[58] Field of Search ..... 399/258, 262, 399/263; 222/DIG. 1

[56] References Cited

U.S. PATENT DOCUMENTS 5,260,750 11/1993 Ishida et al. ..... 399/262
5,398,849 3/1995 Smith et al. ..... 399/262
5,589,919 12/1996 Ikunami et al. ..... 399/262
5,794,108 8/1998 Yoshizawa et al. ..... 399/262

*Primary Examiner*—William Royer
*Assistant Examiner*—William A. Noé
*Attorney, Agent, or Firm*—Jordan B. Bierman; Bierman, Muserlian and Lucas

[57] ABSTRACT

A toner container for use in an image forming apparatus having a toner receiving section, includes a cylindrical container body in which toner is stored, the cylindrical container body having a toner discharging end and provided with a spiral rib provided on its inner circumferential surface so that toner is conveyed toward the toner discharging end by the spiral rib when the cylindrical container body is rotated, the cylindrical container body further having a cylindrical portion with a discharging port on the toner discharging end; and a sleeve member mounted around the cylindrical portion so that the discharging port is closed by the sleeve member, the sleeve member movable in the axial direction of the cylindrical portion so that when the toner container is attached to the toner receiving section of the image forming apparatus, the sleeve member is moved so as to open the toner discharging port.

9 Claims, 14 Drawing Sheets

DEVELOPER CARTRIDGE AND DEVELOPER REPLENISHING APPARATUS

BACKGROUND OF THE INVENTION

This invention relates to a developing apparatus for electrophotographic recording, and in particular to a toner container which contains toner in its cylinder-shaped container body and discharges the toner with rotation, and a toner replenishing device which is fitted with the container and replenishes toner therein to a toner storing portion by rotating the container.

Heretofore, there has been such type of means for replenishing toner from the toner container (toner cartridge) to the toner storing portion in the image forming apparatus as the following: every time when toner is to be replenished, the toner container is attached to the image forming apparatus to replenish whole toner in the container to the storing portion, and it is taken away from the apparatus mainframe after the replenishing is finished. However, in the above-mentioned type of replenishing method, the toner may overflow out of the storing portion in case of excessive replenishment, because the whole toner is fed at a time to the storing portion, and therefore some means must be provided for preventing the excessive replenishment.

It is difficult to prevent the above-mentioned excessive replenishment of toner, and although some means for preventing the excessive replenishment could be provided in the apparatus mainframe on occasion, it resulted in the higher-costed and larger-sized apparatus. Thus, it has been developed a device of the type that a toner container which has a coil-shaped protrusion inside is attached to the apparatus mainframe, and is rotated around its center axis to cause the toner to be discharged through a toner discharging opening to replenish the toner storing portion with it (Japanese laid open patent H7-295356 etc). This type of device has such advantage that any means for preventing the aforesaid excessive replenishment is not necessary, because the toner container is attached to the apparatus mainframe at all times, and it enables a timely replenishment of toner to the toner storing portion by rotating the toner container on occasion that the toner amount in the storing portion decreases.

However, in the above-mentioned toner replenishing device, the function is effected by mating the toner discharge opening provided at the end surface of the toner container with the toner receiving opening provided at the end surface of the toner storing portion, so that the exact positioning of the above-mentioned discharge opening and receiving opening is required. Moreover, it has such disadvantage that toner is easy to leak from the joint portion of the toner discharging opening and the toner receiving opening on exchanging the toner container. Further, the aforesaid toner container and the aforesaid toner replenishing device to be fitted with the toner container have many subjects to be considered such as how to feed efficiently the toner in its container to the toner storing portion.

SUMMARY OF THE INVENTION

The subject of this invention is to solve the aforesaid problems concerning the toner container and the toner replenishing device which supplies the toner from said container to the developing means.

The toner container of this invention to solve the above-mentioned problems has a spiral rib or a coil-shaped protrusion on the inner surface of the container body and discharges the toner contained in it by rotation, having a projected portion at an approximately central part on the end surface of the container, said projected portion having an opening provided on its outer surface approximately parallel to the center line of the cylindrical body, a scooping-up means to scrape the toner upward with the rotation of the container above its center axis, and a guiding portion to guide the toner which is scooped up by said scooping-up means to said opening.

According to another aspect of the invention to solve the aforesaid problems, the toner container has a coil-shaped protrusion on the inner surface of the cylindrical container body and discharges the toner contained in it by rotation, having a cylindrical portion projected at an approximately central part on the end surface of the container, said projected portion having an opening for discharging the toner provided on its outer surface approximately parallel to the center line of the cylindrical body, and a closing member which is concentric with said cylindrical portion, surrounds the periphery of said cylindrical portion, and moves parallelly to the center line of the cylindrical body to open-or-close said opening.

According to an aspect of the invention to solve the aforesaid problems, the toner replenishing device is mounted with a toner container which has a coil-shaped protrusion on the inner surface of the container body and replenishes the toner contained in the container to a toner-storing portion which stores the toner by rotating said toner container, said toner container having a projected portion at an approximately central part on the end surface of the container, said projected portion having an opening provided on its outer surface approximately parallel to the center line of the cylindrical body, said toner container also having a scooping-up means to scrape the toner upward with the rotation of the container above its center axis and a guiding portion to guide the toner which is scooped up by said scooping-up means to said opening, and replenishes said toner storing portion with the toner by rotating said toner container to drop the toner particles from said opening of said projected portion of said toner container through the toner replenishing opening of said toner guide means.

According to another aspect of the invention to solve the aforesaid problems, the toner replenishing device has a toner container having a cylindrical body to contain toner and discharging the toner from the opening provided on the peripheral surface of the body, a toner guiding means which is mounted with said toner container, receives the toner at the opening provided at the position facing to said opening of said toner container, and guides it through a toner feeding path to discharge it from the toner replenishing opening, and a toner storing portion which receives the toner to store, the toner being discharged from said toner container, guided through the toner feeding path, and discharged from said toner replenishing opening, and replenishes said toner storing portion with the toner by rotating said toner container to drop the toner particles from said toner replenishing portion of said toner container through the toner replenishing opening of said toner guide means.

DETAILED DESCRIPTION OF THE PREFERRED EMBODIMENT

Preceding the explanation of the embodiments of the invention, the construction of a color printer, an example of the color image forming apparatus equipped with plural sets of the toner replenishing devices of this invention and the developing units, and its operation will be explained with reference to the cross-sectional view showing the construction of FIG. 1.

This color printer is a color image forming apparatus which has a mode of operation as the following: color images formed on the image forming member with one color image superposed on another are transferred to a sheet of transfer paper at a time to form a full color image at the transfer station, and then it is picked off from the surface of the image forming member.

Figure 1:
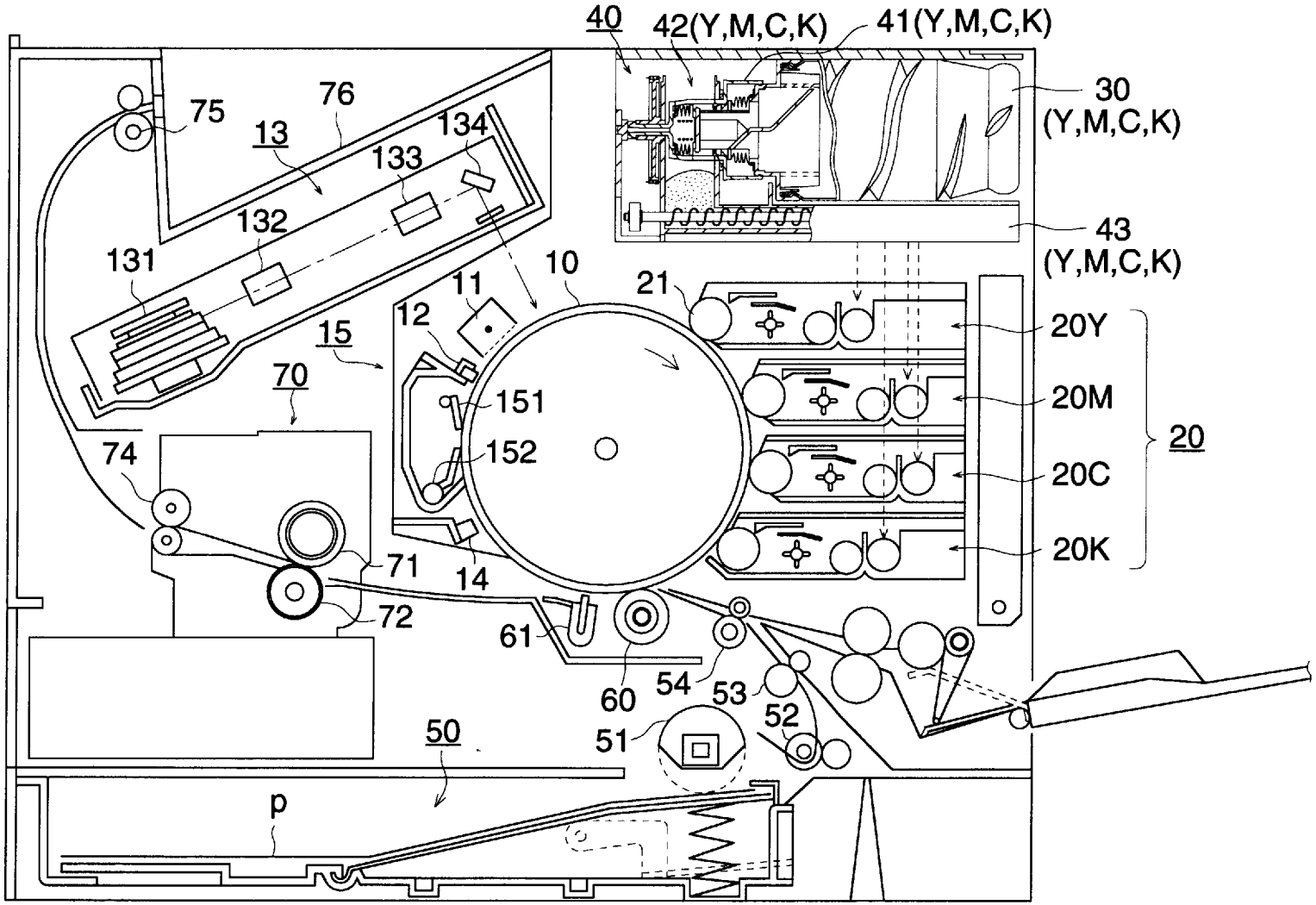
FIG. 1 is a cross-sectional view showing the construction of a color printer, an example of the color image forming apparatus equipped with a plurality of toner replenishing devices.
Figure 11:
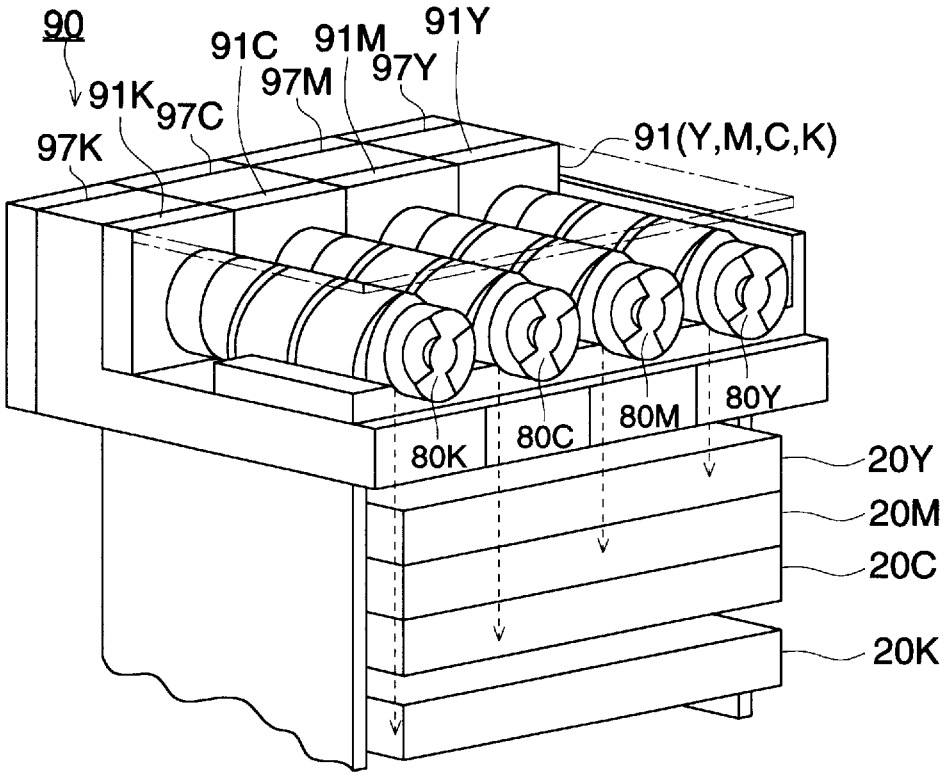
FIG. 11 is a perspective view of the toner replenishing devices mounted with the toner containers shown in the FIG. 10.

In FIG. 1, 10 is a photoreceptor drum, the image forming member, composed of an OPC-photoreceptor (organic photoconductor) coated on a drum-shaped base member, which is grounded and driven clockwise as shown in the figure. 11 is a scorotron charging device which gives the peripheral surface of the photoreceptor drum a uniform electrostatic charge of a high potential $V_H$ with a grid which is kept at a grid potential $V_G$ and a corona discharging of a corona discharging wire. Before this charging with the scorotron charging device 11, the charge on the peripheral surface of the photoreceptor is eliminated by exposure to PCL (pre-charging lamp) 12 composed of a phtodiode or other proper means in order to eliminate the memory effect of the photoreceptor due to previous printings.

After the uniform charging on the photoreceptor drum 10, the imagewise exposure process based on the image signal is done by the imagewise exposure means 13. As regards the imagewise exposure means 13, the main-scanning is done as the following: the light beam emitted from the light source of a laser diode goes through a rotating polygon mirror 131, an fθ lens 132, and a cylindrical lens 133, with its path deflected by a reflection mirror 134, reaches to the surface of the photoreceptor; thus the latent image is formed together with the rotation of the photoreceptor drum 10 (sub-scanning). In this mode of practice of the invention, the light is emitted corresponding to the letter part of the original document, so the reversal latent image is formed, in which the potential on the photoreceptor surface corresponding to the letter part is made low as $V_L$.

Around the periphery of the photoreceptor drum 10, there is provided a developing apparatus 20 composed of the developing units 20Y, 20M, 20C, and 20K, each having inside a two-component developer composed of one of the toners of yellow (Y), magenta (M), cyan (C), and black (K) respectively and carrier material.

First, the yellow, the first color, development is done with a rotating developer carrying member (developing sleeve) 21 which has magnets inside and holds the developer. The developer is composed of carrier beads, each of them composed of a ferrite core and a coated layer of insulating resin on it, and the toner particles, each of them composed of polyester resin as main material, a pigment corresponding to the color, and a charge control agent, micro-particles of silica or titanium oxide adhering on it, forms a layer with a thickness between 100 and 600 $\mu$m, regulated with a layer forming means, and is carried to the developing region.

The spacing from the developing sleeve 21 to the photoreceptor drum 10 at the developing region is 0.2–1.0 mm, which is a little larger than the developer layer thickness, and an AC bias voltage $V_{AC}$ and a DC bias voltage $V_{DC}$ overlapped on it is applied to the spacing. Because the DC bias $V_{DC}$, high potential $V_H$, and the toner charge has the same polarity, the toner particles which are given the chance of taking off from the carrier beads by the AC bias $V_{AC}$ will not deposit on the area having the high potential $V_H$ which is higher than the DC bias $V_{DC}$, but deposit on the area having the low potential VL which is lower than the DC bias $V_{DC}$ to make a visible image (reversal development).

Afer the first color image was made visible, then the second color magenta image forming process starts. Again the uniform charging with the scorotron charging device 11 is done to form the latent image corresponding to the image data of the second color using the imagewise exposure means 13. The charge elimination by PCL 12, which was made in the first color image forming process, is not practised this time in order to prevent the toner scattering due to the sudden lowering of the potential of neighboring area.

In the photoreceptor surface area, which is again charged to a high potential $V_H$ overall, as regards those areas that have no image of the first color, the latent image is formed just like the first color and developed, but on those areas where the first color toner particles have been deposited, due to the light shielding by the deposited toner particles and the charge of the toner particles which they have originally, the latent image of potential $V_M'$ is formed and developed in accordance with the potential difference between the DC bias $V_{DC}$ and the potential $V_M'$. In these overlapped areas by the first and second color images, if the first color image is formed with the latent image of low potential $V_L$, the color balance between the first and the second will be lost, and hence the first color imagewise exposure is sometimes so reduced as to make the potential intermediate value $V_M'$ to satisfy the following inequality $V_H>V_M'>V_L$.

For the third color cyan and the fourth color black the image forming process like that for the second color magenta is carried out; the four color visible image is formed on the peripheral surface of the photoreceptor drum 10.

The toner replenishing device 40, which replenishes the fresh toner of each color controlled to each of the aforesaid developing units 20Y, 20M, 20C, and 20K, is composed of a plurality of the container mounting portions 41Y, 41M, 41C, and 41K, to each of which each of the toner containers (hereinafter refered to as the containers) 30Y, 30M, 30C, and 30K are able to be mounted or dismounted respectively, a plurality of the toner storing portions 42Y, 42M, 42C, and 42K, which store temporarily the toners in said container 30Y, 30M, 30C, and 30K, and a plurality of the toner feeding portions 43Y, 43M, 43C, and 43K, which feed the toners in said toner storing portions to the aforesaid developing units 20Y, 20M, 20C, and 20K.

On the other hand, a sheet of transfer material (transfer paper etc), which is conveyed out from the paper feeding casette 50 with a half-moon-shaped roller 51, goes through a pair of paper feeding rollers 52 and 53 and stops once in the vicinity of a registration roller pair 54, and is fed to the transfer region with the rotation of the registration roller pair 54 at the moment of the proper timing of the transfer.

In the transfer region, the transfer means 60 is pressed to contact the periphery of the photoreceptor drum 10 synchronized with the transfer timing, hold the fed transfer material sheet p to contact the drum to transfer the multicolored image at a time.

Next, the transfer material sheet p is processed by the pick-off means 61 to eliminate the charge on it, picked off from the peripheral surface of the photoreceptor drum 10, conveyed to the fixing apparatus 70, where the toner is fused by the heating and pressing with the heat roller (upper roller) 71 and the press roller (lower roller) 72, then discharged onto the receiving tray 76 provided outside the printer body by the paper ejecting rollers 74 and 75. In the meanwhile, the aforesaid transfer means 60 is retracted apart from the photoreceptor periphery after the passing through of the transfer sheet p to be ready for the next toner image forming.

On the other hand, the photoreceptor drum 10 from which the transfer sheet p is picked off is subjected to the charge elimimation process by the charge eliminating device 14, the residual toner particles on it removed to clean its surface by pressing the blade 151 of the cleaning apparatus 15, is again subjected to the charge elimination by the aforesaid PCL 12 and charging by the scorotron charging device 11 to enter into the next image forming process. Further, the aforesaid blade 151 moves to be retracted from the photoreceptor periphery immediately after the cleaning of the photoreceptor surface. The waste toner scooped off by the blade 151 into the cleaning apparatus 15 is discharged with the screw 152 and then stored in the collecting container for the waste toner which is not shown in the drawings.

Figure 2:
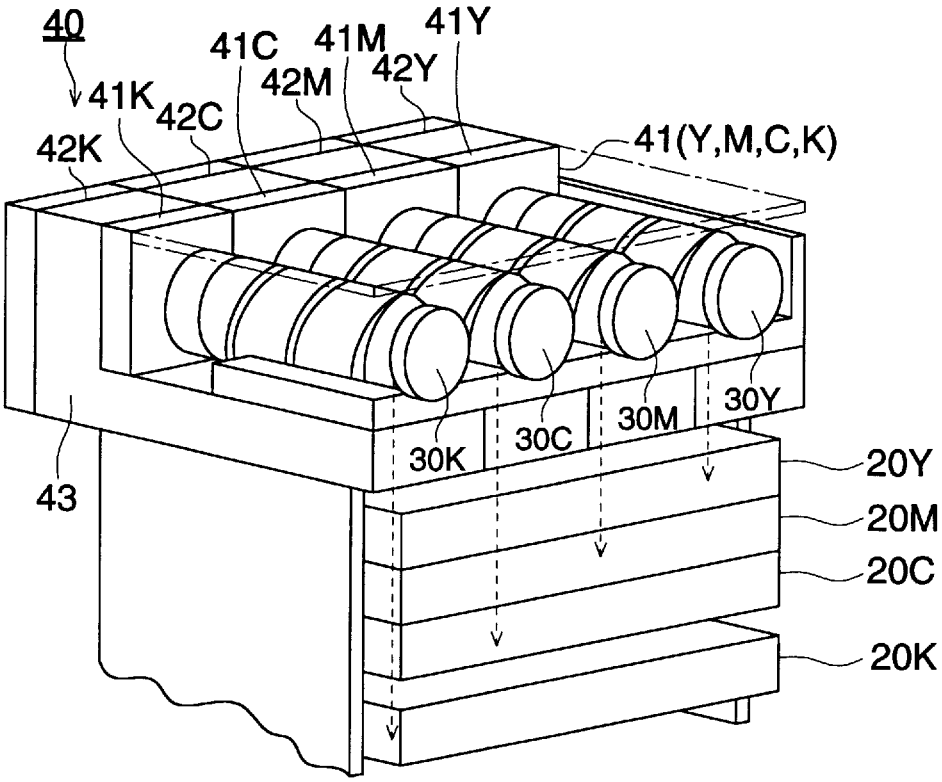
FIG. 2 is a perspective view showing a plurality of the toner containers and a plurality of the toner storing portions, and a part of plural developing units.

FIG. 2 is a perspective view showing a plurality of the toner containers 30Y, 30M, 30C, and 30K, a plurality of the toner storing portions 42Y, 42M, 42C, and 42K, and a part of plural developing units 20Y, 20M, 20C, and 20K. Each of the container mounting portions 41Y, 41M, 41C, and 41K has each of the four toner containers 30Y, 30M, 30C, and 30K respectively placed parallelly on about the same plane and enables them to be mounted or dismounted. They are constructed to operate in such a controlled manner that upon decreasing of the amount of any toner in said developing units 20Y, 20M, 20C, and 20K, the corresponding toner in said toner containers 30Y, 30M, 30C, and 30K is replenished. Because these toner containers 30Y, 30M, 30C, and 30K all have almost the same construction, hereinafter the explanation will be given with reference to the container 30 as the representative of the containers 30Y, 30M, 30C, and 30K.

Figure 3:
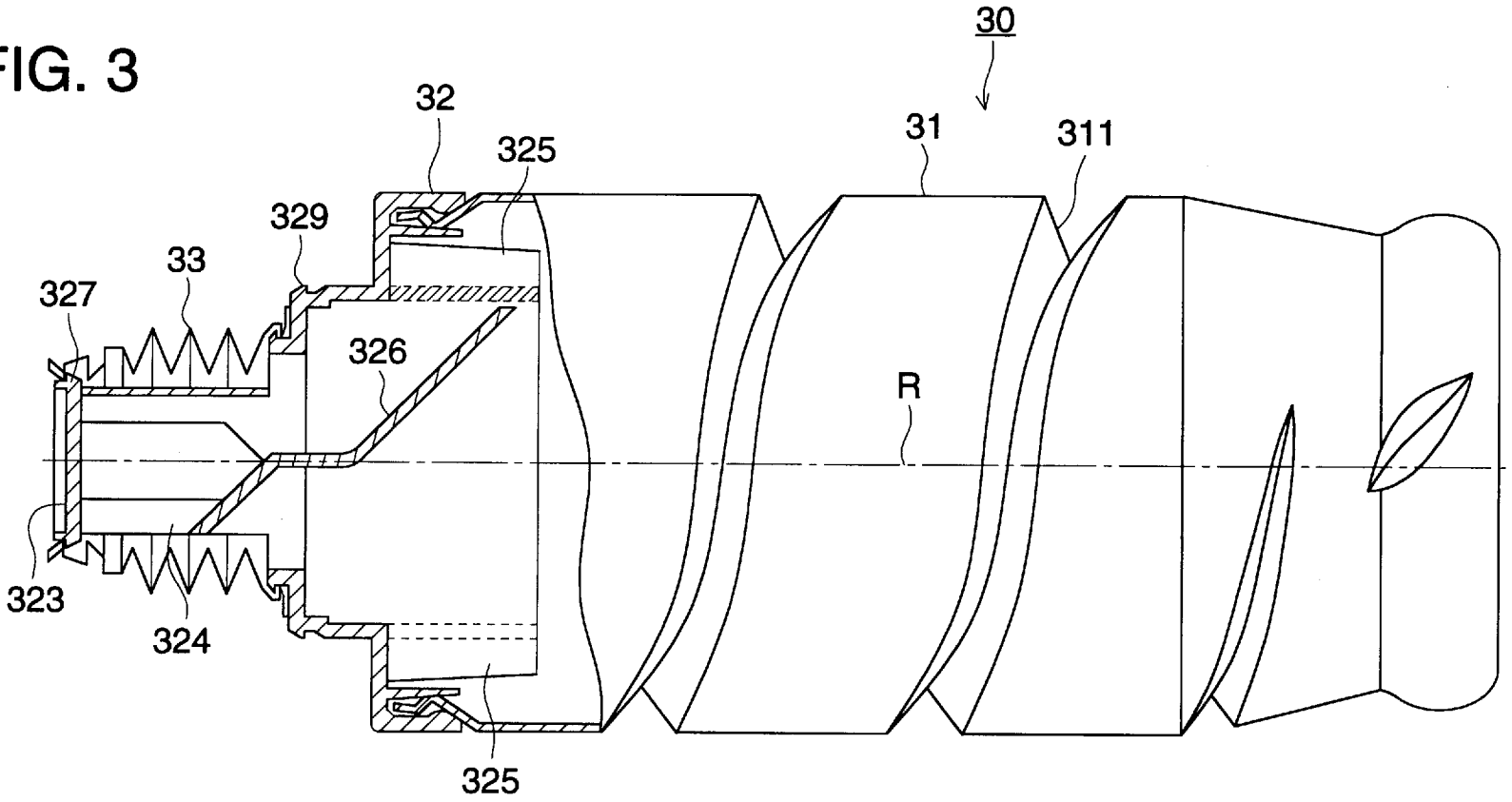
FIG. 3 is a partially cross-sectional, side view of the toner container.
Figure 4:
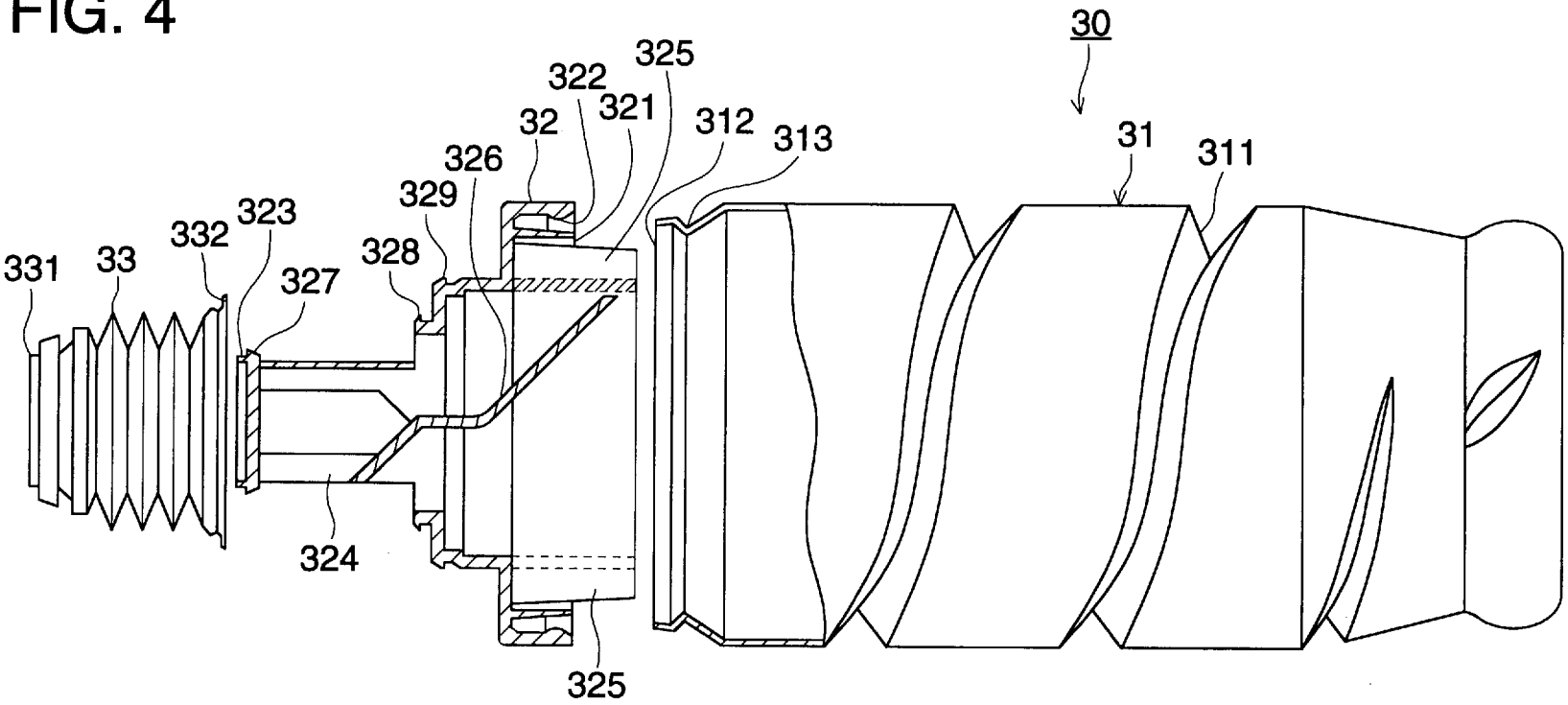
FIG. 4 is a partially exploded, side view of the toner container.
Figure 5:
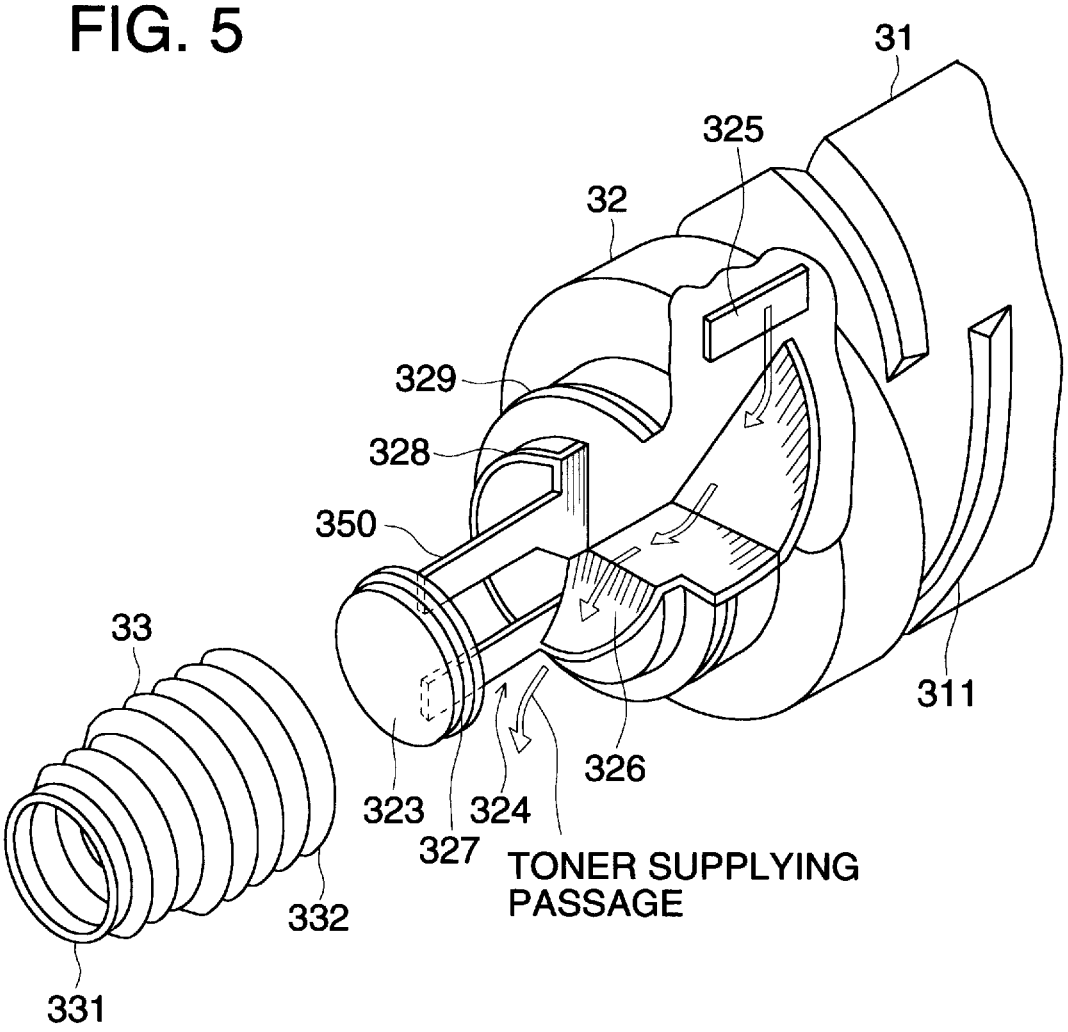
FIG. 5 is an exploded perspective view of the toner discharging portion of the toner container.

Now in reference to the FIG. 3–FIG. 7 the first example of practice of this invention will be disclosed. FIG. 3 is a partial cross-sectional side view of the container 30; FIG. 4 is an exploded side view of said container; and FIG. 5 is an exploded perspective view of said container.

The container 30 is composed of a cylindrical container body 31 containing the toner inside, a fixed cover 32 fixed to said container body 31, and a container opening-or-closing cover 33 which is capable of expansion and contraction.

One side of the container body 31 is opened as to form an opening 312. A guide portion (toner conducting portion) consisting of a coil-shaped protrusion 311 is formed on the inner surface of said container body 31, and the toner contained in the container body 31 is guided along the coil-shaped protrusion 311 to move to the direction of the opening 312. 313 is an engaging portion of a V-shaped groove provided on the cylinder surface in the vicinity of said opening 312, fitted closely with an engaging portion 322 of convex shape provided in the vicinity of an opening 321 of said fixed cover 32, which will be explained later, to make both engaging portion unite, so as to fix the opening 312 and the opening 321 of the fixed cover 32.

On one side (right-hand side in the drawing) of the fixed cover 32, there are provided an opening 321 which is opposite to the opening of the aforesaid container body 31 and the engaging portion 322 of convex shape provided in the vicinity of the opening 321, and by joining and fixing the opening 312 of the container body 31, the openings 312 and 321 communicate with each other. At the approximately central part of the other side (left-hand side) of the fixed cover 32 is formed a projected portion 350. The bumping portion 350 323 at the extreme end surface of said projected portion 350 contacts with an opening-or-closing cover of the container-mounting portion 41, which will be explained later. On the outer peripheral surface of said projected portion 350 is provided through its wall, a plurality of openings (openings for replenishing) 324, for the purpose of discharging the toner in the aforesaid container body 31 to accumulate it in the toner storing portion of the toner replenishing device 40, which will be explained later.

Inside the fixed cover 32 are placed and fixed the scooping-up portion (paddle) 325 composed of 2~4 plate members to scrape up the toner above the center axis of rotation R of the container 30 and the toner guiding portion 326 made of sloping surface to move-to-guide the toner scooped up by said scooping-up portion 325 to the aforesaid opening 324.

On the peripheral surface of the above-mentioned projected portion of the fixed cover 32, protruded claw portions are formed at three points. The first protruded claw portion 327 provided in the vicinity of the aforesaid bumping portion 323 of the projected portion engages with an engaging portion 331 provided in the vicinity of the left end portion, with regard to the drawing, of the aforesaid container opening-or-closing cover 33, being able to hold or disengage with the engaging portion 331. The second protruded claw portion 328 is fixed to engage with an engaging portion 332 provided in the vicinity of right end portion, with regard to the drawing, of the aforesaid container opening-or-closing cover 33.

The third protruded claw portion 329 engages with a container-slipping-off preventing portion 444 of the driving-force transmitting member 44, which will be explained later, being able to engage or disengage with the preventing portion 444.

The above-mentioned engaging portion 331 provided in the vicinity of the leftend portion, with regard to the drawing, of the aforesaid container opening-or-closing cover 33 is able to be engaged or disengaged with the aforesaid first protruded claw portion 327. The middle part of said container opening-or-closing cover 33 is formed like a bellows and is capable of expansion and contraction in the direction of the center axis of rotation. Said container opening-or-closing cover 33 is formed like a bellows by blow molding method, and is fixed (fused to bond) to the aforesaid second protruded claw portion 328 by ultrasonic bonding. This bonding may be made by an adhesive.

Figure 6:
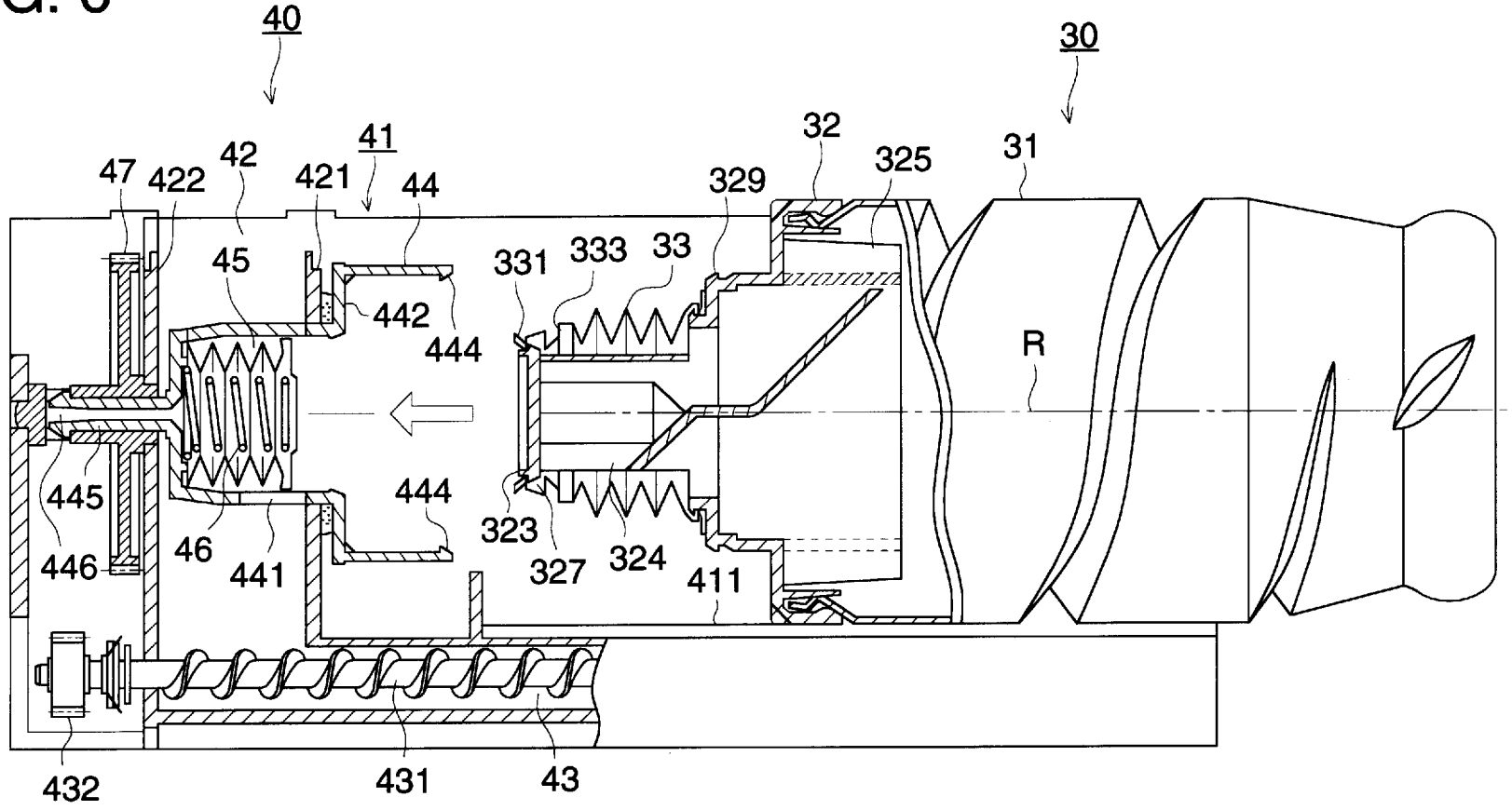
FIG. 6 shows a cross-sectional view showing the container mounting portion and the toner container as they are spaced apart.
Figure 7:
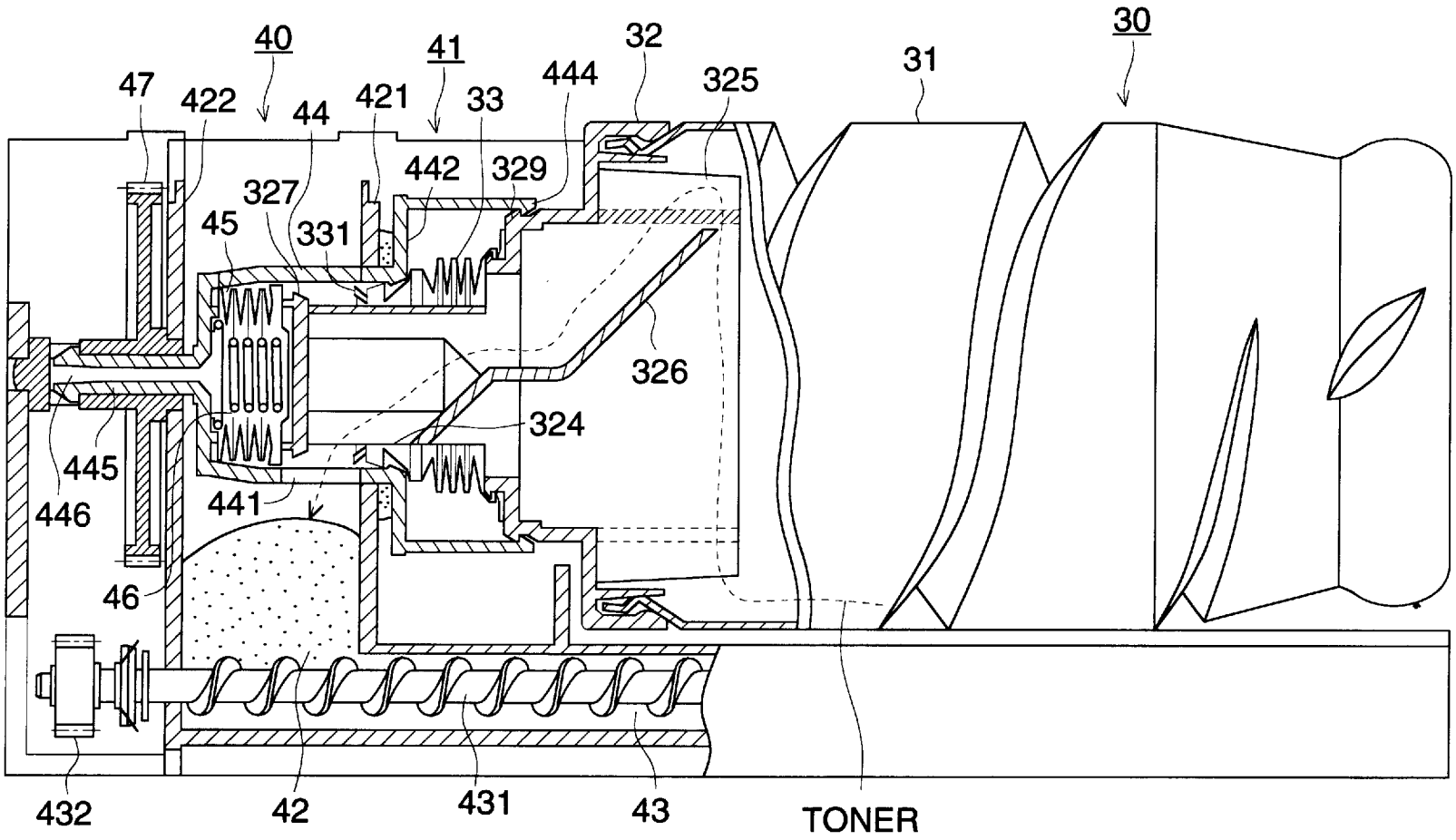
FIG. 7 is a cross-sectional view showing the toner container mounted to the container mounting portion.

FIG. 6 is a cross-sectional view showing the aforesaid container 30 before mounting to the container mounting portion 41 of the toner replenishing device 40, that is, as it is spaced apart from the container mounting portion 41; and FIG. 7 is a cross-sectional view of the container 30, the container mounting portion 41, the toner storing portion 42, and the toner feeding portion 43, with said container mounted to the container mounting portion 41.

The driving-force transmitting member 44 is supported, being capable of rotation, with two parallel upright walls 421 and 422 making up the aforesaid toner storing portion (toner hopper) 42. At the position which is opposite to the aforesaid bumping portion 323 of the container 30 and inside said driving-force transmitting member 44, the opening-or-closing cover 45 of the toner-replenishing device is placed and urged with a coil spying 46. The container-slipping-off preventing portion 444 is composed of a plurality of arms projected from the right-hand side, with regard to the drawing, of the driving-force transmitting member 44, each of the arms having an engaging claw at the end portion. Said container-slipping-off preventing portion 444 engages with the aforesaid third protruded claw portion 329 of the container 30, being capable of engaging and disengaging. Further, at the approximately central part, with regard to the direction of the center axis of rotation, of the driving-force transmitting member 44, a plurality of openings (toner discharging openings) 441 is provided through the peripheral wall. Furthermore, at the shaft part in the neighborhood of the left-hand side, with ragard to the drawing, of said driving-force transmitting member 44, the container rotating gear 47 is fixed. Said container rotating gear 47 is driven to rotate with a drive source which is not shown in the drawings.

The aforesaid container is held by the container mounting portion 41 to be guided on its guide platform 411 to the left direction, with regard to the drawing, until the bumping portion 323 at the extreme end of the container 30 contacts with the right-hand side surface of the aforesaid opening-or-closing cover 45 of the toner replenishing device. Corresponding to successive moving of the container to the left direction, with regard to the drawing, the opening-or-closing cover 45 of the toner replenishing device is compressed against the force of the coil spring 46, gradually to open the openings (toner discharging openings) 441; when the aforesaid driving-force transmitting member 44 engages with the the third protruded claw portion 329 to be joined to it, the opening 441 comes to the full-open state.

In this process of moving of the container 30, the bumping portion 323 of the aforesaid container opening-or-closing cover 33 capable of expansion and contraction bumps the inner wall 442 of the aforesaid driving-force transmitting member 44, prevented from going forward, and upon further moving of the container, the engaging portion 331 at the extreme end of the container opening-or-closing cover 33 disengages from the first protruded claw portion 327 at the extreme end of the container 30, to gradually open the openings (openings for replenishing) 324 on the side of the container 30; and at last when the aforesaid driving-force transmitting member 44 engages with the third protruded claw portion 329 to be joined to it, the openings 324 comes to the full-open state.

On the outer surface of the rotary shaft portion 445 a projected to the left, with regard to the drawing, out of the aforesaid driving-force transmitting member 44, the aforesaid container rotating gear is fixed to make them united. The central portion of the shaft of the driving-force transmitting member 44 is hollow, a through hole 446 being formed. Said through hole 446 is made in order that when the container 30 is mounted to the container mounting portion 41, the air in the opening-or-closing cover 45 for the toner replenishing device, compressed by the bumping portion 323 at the end of the container 30, may exhaust to the outside of the toner replenishing device. Accordingly, because the air flow does not come into the toner hopper when the container is being mounted and the opening-or-closing cover 45 for the toner replenishing device is being opened, the toner in the hopper will never be scattered.

After the container 30 and the driving-force transmitting member 44 has been engaged and joined in the above-mentioned manner, the aforesaid openings 324 on the side of the container 30 and the opening 441 on the side of the toner replenishing device 40 are brought into the state of being open to each other. On driving the gear 47 to rotate by the drive source, the container 30 and the driving-force transmitting member 44 which are united with the gear are driven to rotate as a united body; thus the toner contained in the container body 31 of the container 30 is propelled with the coil-shaped protrusion 311 to the direction of the opening 312, then scooped upward by the scooping-up portion (paddle) 325, next sliding down the slope of the toner guiding portion 326 by gravity to be ejected out of the openings 324, and further, passing through the openings (toner discharging openings) 441 of the driving-force transmitting member 44, received in the hopper of the toner storing portion 42.

The amount of the toner received in said toner storing portion 42 is detected by a photo-detector means, and when it reaches to the predetermined value, the driving of drive source is stopped to cease the replenishing of the toner from the container 30.

Moreover, while aforesaid container 30 is rotated by the driving-force transmitting member 44 to replenish the toner to the toner storing portion 42, even if a predetermined amount of the toner becomes stored in the toner storing portion 42, continuing of the rotation of the container will not make any problem, because the toner is not replenished in this state in spite of the continued rotation of the container 30.

The toner received in the hopper of the toner storing portion 42, is fed into the feeding screw 431 fixed to the feeding-screw gear 432 connected to a drive source, which is not shown in the drawing, conveyed in the toner feeding portion 43, and is replenished to the aforesaid developing unit 20.

Figure 8:
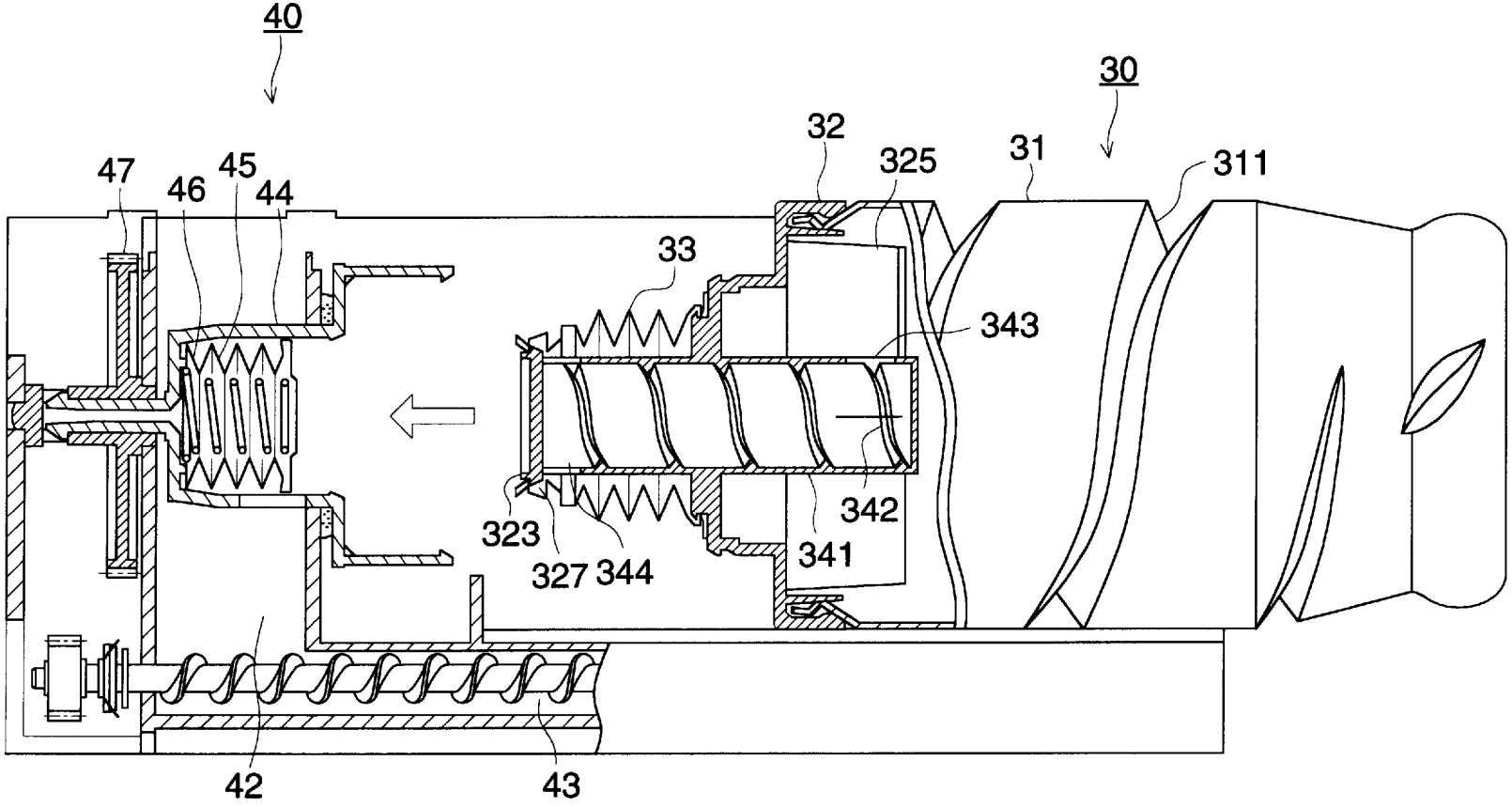
FIG. 8 is a cross-sectional view showing the toner container and the toner replenishing device according to another aspect of the invention.
Figure 9:
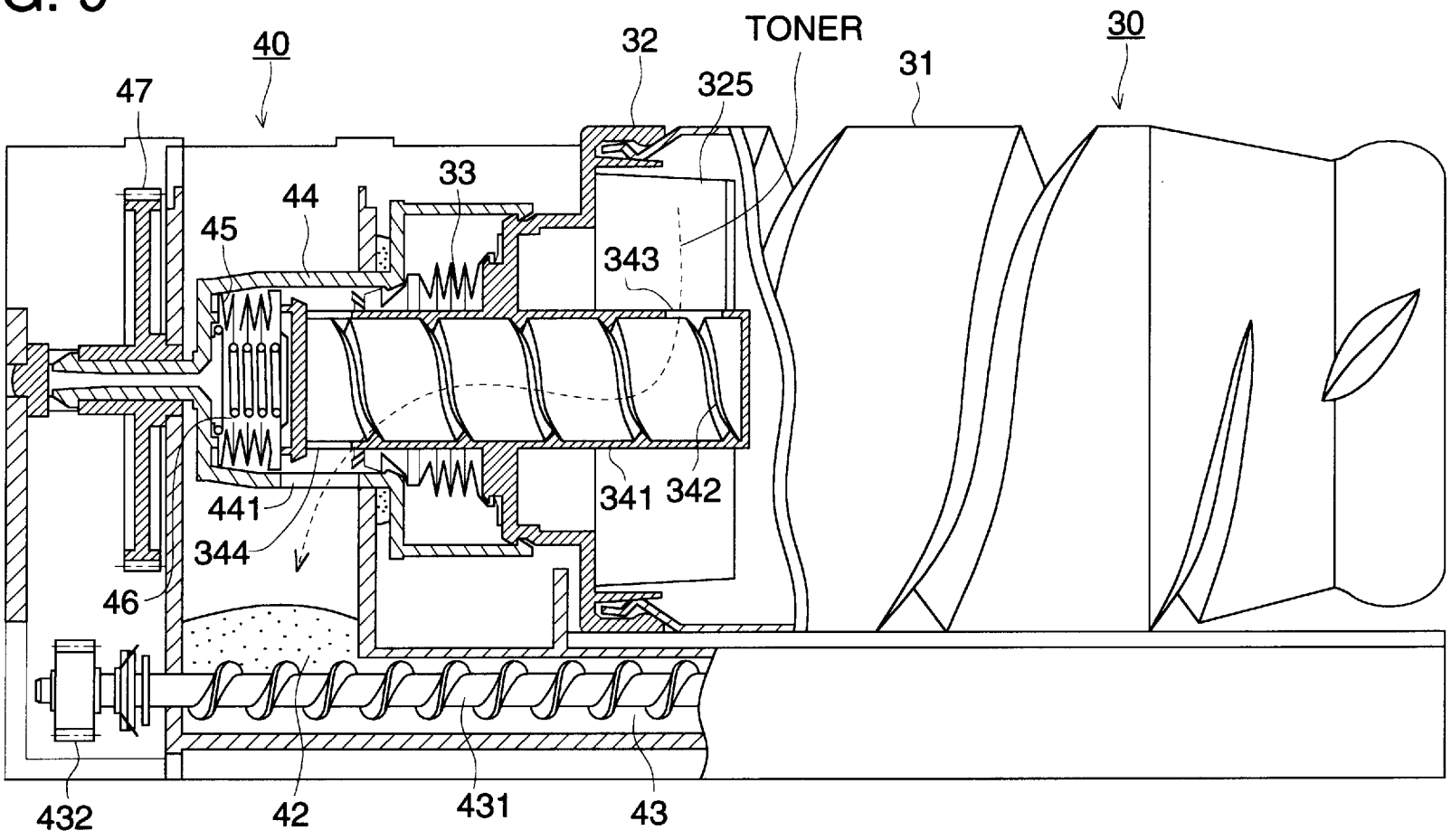
FIG. 9 is a cross-sectional view of the toner container shown in the FIG. 8 mounted to the toner replenishing device.

FIG. 8 and FIG. 9 are cross-sectional views showing the second example of practice of this invention; FIG. 8 is a cross-sectional view showing the container 30 before mounting to the container mounting portion 41 of the toner replenishing device 40, that is, as it is spaced apart from the container mounting portion 41; and FIG. 9 shows a cross-sectional view of said container 30 as it is mounted to the toner replenishing device 40.

The toner replenishing device in this mode of practice of the invention has the same construction as that shown in the above-described FIG. 3–FIG. 7, and only the container 30 has a different construction. Further, the same marks are used for the matters in FIG. 8 and FIG. 9 too, as long as they have the same function as those in said FIG. 3–FIG. 7. Furthermore, only the different points from the aforesaid example of practice will be explained.

Inside the aforesaid fixed cover 32, the toner discharging portion 341 having a hollow cylinder shape is formed unitedly. On the inner side of said toner discharging portion 341, a coil-shaped protrusion 342 is formed. At the position near the end of one side of said toner discharging portion 341, the position being also in the vicinity of the opening 312 of the container body 31, a toner introducing opening 343 is provided through its wall. At the position in the vicinity of the aforesaid bumping portion 323 on the other side portion of the toner discharging portion 341, the toner discharging opening 344 is provided through its wall. Further, in the vicinity of the aforesaid toner introducing opening 343 inside the aforesaid fixed cover 32, the scooping-up portion (paddle) 325 is formed unitedly.

When the container 30 is mounted to the toner replenishing device and driven to rotate, the toner contained in the container body 31 of said container 30 is propelled by the coil-shaped protrusion 311 to the direction of the opening 312, then scooped upward by the scooping-up portion (paddle) 325, next sliding down the slope of the scooping-up portion 325 by gravity to be introduced through the toner introducing opening 343 into the toner discharging portion 341 having a hollow cylinder shape, wherein the toner moves to the left direction, with regard to the drawing, guided by the coil-shaped protrusion 342 along the center axis, then discharged from the toner discharging opening 344 in the opened state as the container opening-or-closing cover 33 has already been retracted; finally the toner passes through the opening 441 on the side of the aforesaid toner replenishing device 40, and is received in the hopper of the toner storing portion 42.

Figure 10:
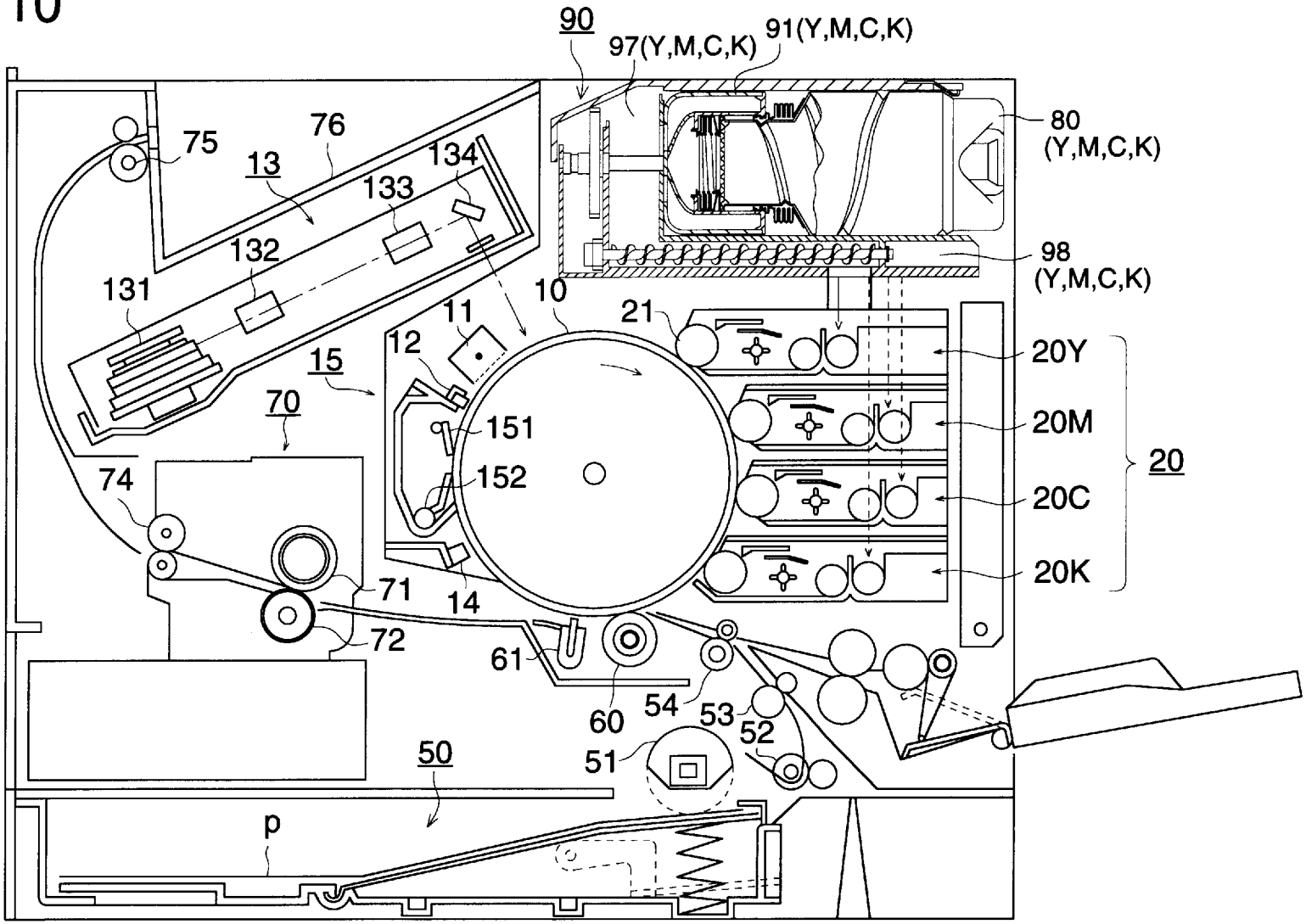
FIG. 10 is a cross-sectional view showing the construction of a color printer, an example of the color image forming apparatus equipped with a plurality of the toner replenishing devices of the third example of practice of the invention and a plurality of the developing units.

Hereinafter with reference to FIG. 10–FIG. 15, the third example of this invention will be disclosed. FIG. 10 is a cross-sectional view showing the construction of a color printer. FIG. 11 is a perspective view of the toner replenishing device 90 mounted with the toner container 80Y, 80M, 80C, and 80K.

Each of the container mounting portions 91Y, 91M, 91C, and 91K has each of the four toner containers 80Y, 80M, 80C, and 80K respectively placed parallelly on about the same plane and enables them to be mounted or dismounted. Each of the toner storing portions 97Y, 97M, 97C, and 97K stores each color toner respectively, and upon decreasing of the amount of any toner in said developing units 20Y, 20M, 20C, and 20K, the corresponding toner is replenished in a controlled manner.

Because these toner containers 80Y, 80M, 80C, and 80K all have almost the same construction, hereinafter the explanation will be given with reference to the container 80 as the representative of the containers 80Y, 80M, 80C, and 80K; the container mounting portion 91 is referred to as the representative of container mounting portions 91Y, 91M, 91C, and 91K; and the toner storing portion 97 is referred to as the representative of the toner storing portions 97Y, 97M, 97C, and 97K.

Figure 12:
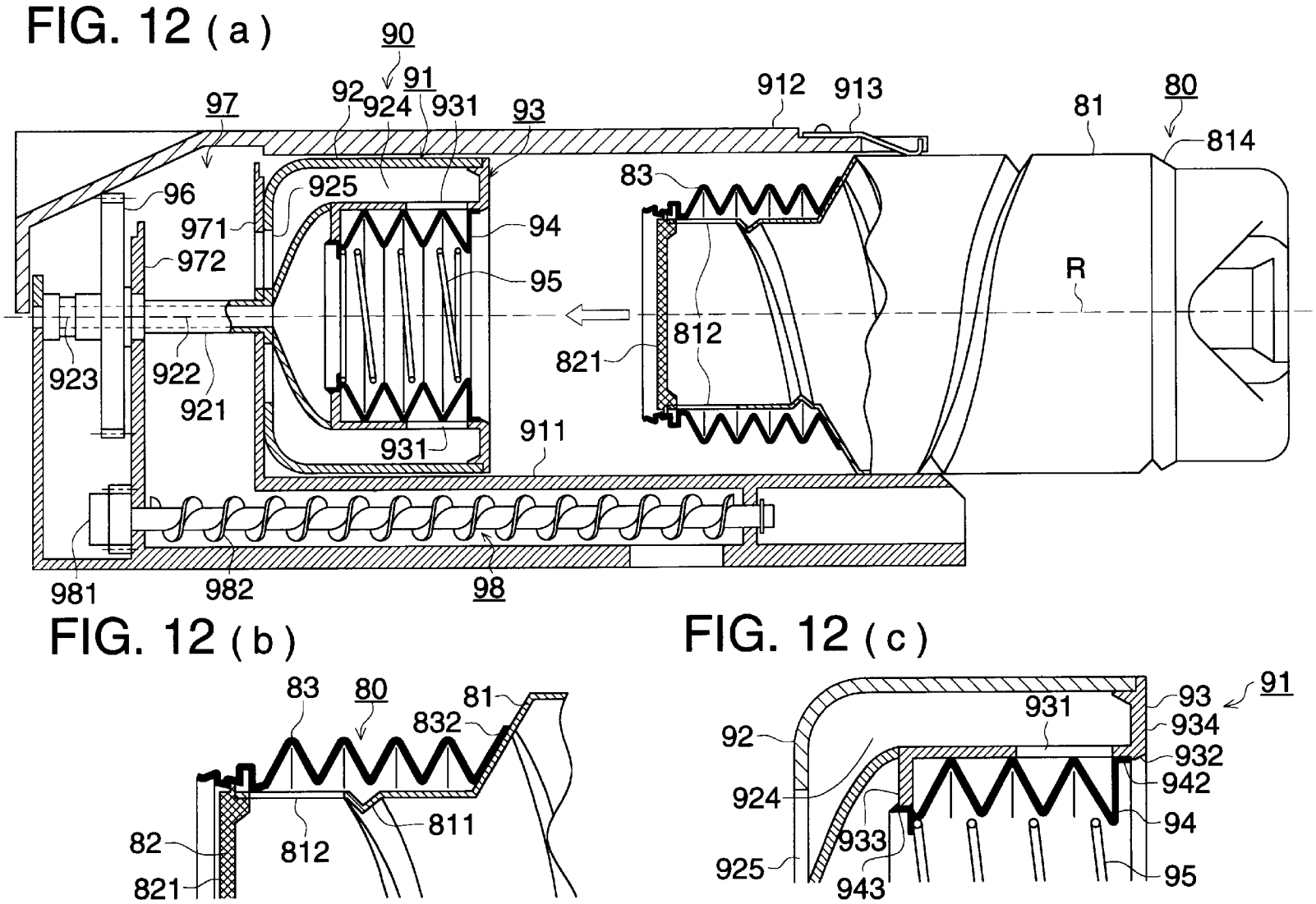
FIG. 12(*a*) shows a cross-sectional view of the container mounting portion and the toner container shown in FIG. 10 as they are spaced apart, FIG. 12(*b*) shows an enlarged partial cross-sectional view of said container, and FIG. 12(*c*) shows an enlarged partial cross-sectional view of the container mounting portion.

FIG. 12(*a*) shows a cross-sectional view of the aforesaid container mounting portion 91 of the toner replenishing device 90 and the toner container 80 before mounted, that is, as they are spaced apart; FIG. 12(*b*) is an enlarged partial cross-sectional view of said container 80; and FIG. 12(*c*) is an enlarged partial cross-sectional view of the container mounting portion 91.

The container 80 is composed of a cylindrical container body 81 containing the toner inside, a fixed cover 82 to fix the side surface, in the direction of the rotation axis, of said container body 81, and a container opening-or-closinge cover 83 which is fixed at its one end to the aforesaid container body and capable of expansion and contraction.

An opening is provided on the projected portion of one side, with regard to the direction of the rotation axis, and is closed and fixed by the aforesaid fixed cover 82. A guide portion (toner conducting portion) consisting of a coil-shaped protrusion 811 is formed on the inner surface of said container body 81, and the toner contained in the container body 81 is guided along the coil-shaped protrusion 811 to move to the direction of the fixed cover 82.

On the peripheral surface of the aforesaid projected portion of the container body 81, a plurality of openings (toner discharging openings) 812 for discharging the toner in the container body 81 is provided through its wall, the toner conveyed through the container mounting portion 91 of the toner replenishing device, which will be explained later, to be received and accumulated in the toner storing portion 97.

On the end side (left-hand side with regard to the drawings) of the fixed cover 82, a flat bumping portion 821 is formed, and contacts the opening-or-closing cover 94 (for the mounting portion) of the container mounting portion 91. Further, a ring-shaped projected portion is formed on the peripheral surface of the aforesaid fixed cover 82 unitedly, being capable of engaging and disengaging, with the engaging portion (free end) 831 provided in the vicinity of the left end, with regard to the drawing, of the aforesaid container opening-or-closing cover, which is capable of expansion and contraction. The open surface at the right-hand side, with regard to the drawing, of the aforesaid container opening-or-closing cover 83 is a fixing portion (fixed end) 832 which is fixed with close contact to the peripheral surface of the aforesaid container body 81. Said fixing portion 832 is bonded or welded to the container body to make both united.

The aforesaid container-opening-or-closing cover 83 is made of polyethylene resin, is formed by blow molding method, having flexibility, with its outer surface formed to have a plurality of folds like a bellows, and is capable of expansion and contraction in the direction of the rotation axis R. The inside of the container opening-or-closing cover 83 forms a through hollow space.

The aforesaid container mounting portion 91 is composed of an outer cylinder member 92, an inner cylinder member 93, the mounting-portion opening-or-closing cover 94 capable of expansion and contraction, a coil spring 95, and the container rotating gear 96. Said outer cylinder member 92 and said inner cylinder member 93 are formed unitedly, and making up the toner guiding means which receives the toner discharged out of the container 80, and conveys it to replenish the aforesaid toner storing portion 97 with it.

The rotary shaft portion 921 to the left-hand side, with regard to the drawing, of the aforesaid outer cylinder member 92 is supported, being capable of rotation, by the two parallel upright walls 971 and 972 which makes up the aforesaid toner storing portion (toner hopper) 97. At the end of said rotary shaft portion 921, the container rotating gear 96 is fixed. Said container rotating gear 96 is driven to rotate by a drive source which is not shown in the drawings.

The central portion of the aforesaid rotary shaft portion 921 is hollow, with a through hole 922 formed therein. Said through hole 922 is made in order that when the container 80 is mounted to the container mounting portion 91, the air in the mounting-portion opening-or-closing cover 94, compressed by the bumping portion 821 at the end of the container 80, may exhaust through the exhausting hole 923 to the outside of the toner replenishing device 90.

On the peripheral surface of the aforesaid inner cylinder member 93, a plurality of openings (toner discharging openings) 931 is provide through its wall. Said openings 931 communicates with the toner conveying path 924 formed by the aforesaid outer cylinder member 92 and inner cylinder member 93, and further with the aforesaid toner storing portion 97 through the toner replenishing opening 925 provided at the side of the outer cylinder member through its wall.

The engaging protrusion 932 projecting inward at the entrance portion on one side of the aforesaid inner cylinder member 93 engages with the end portion (free end) 942 at the entrance of the aforesaid mounting-portion opening-or-closing cover 94 to prevent the slipping off. Further, the engaging wall portion 933 at the other side of the inner cylinder member 93 is fixed (fused) with the engaging portion (fixed end) 943 at the innermost side of the mounting-portion opening-or-closing cover 94 by ultrasonic bonding. This bonding may be substituted by fixing with an adhesive.

The aforesaid mounting-portion opening-or-closing cover 94 is made of the polyethylene resin and is formed by blow molding method, having flexibility, with its outer surface formed to have a plurality of folds like a bellows, and is capable of expansion and contraction in the direction of the rotation axis R. The inside of the mounting-portion opening-or-closing cover 94 forms a through hollow space. The aforesaid coil spring 95 is placed in said space, being capable of expansion and contraction. Said coil spring 95 extends the mounting-portion opening-or-closing cover 94 by pressing it from the inside. The end portion at the entrance side of the mounting-portion opening-or-closing cover 94 is urged with the aforesaid coil spring 95, but it is a free end, being movable by an external force in the direction of rotation axis R.

Figure 13:
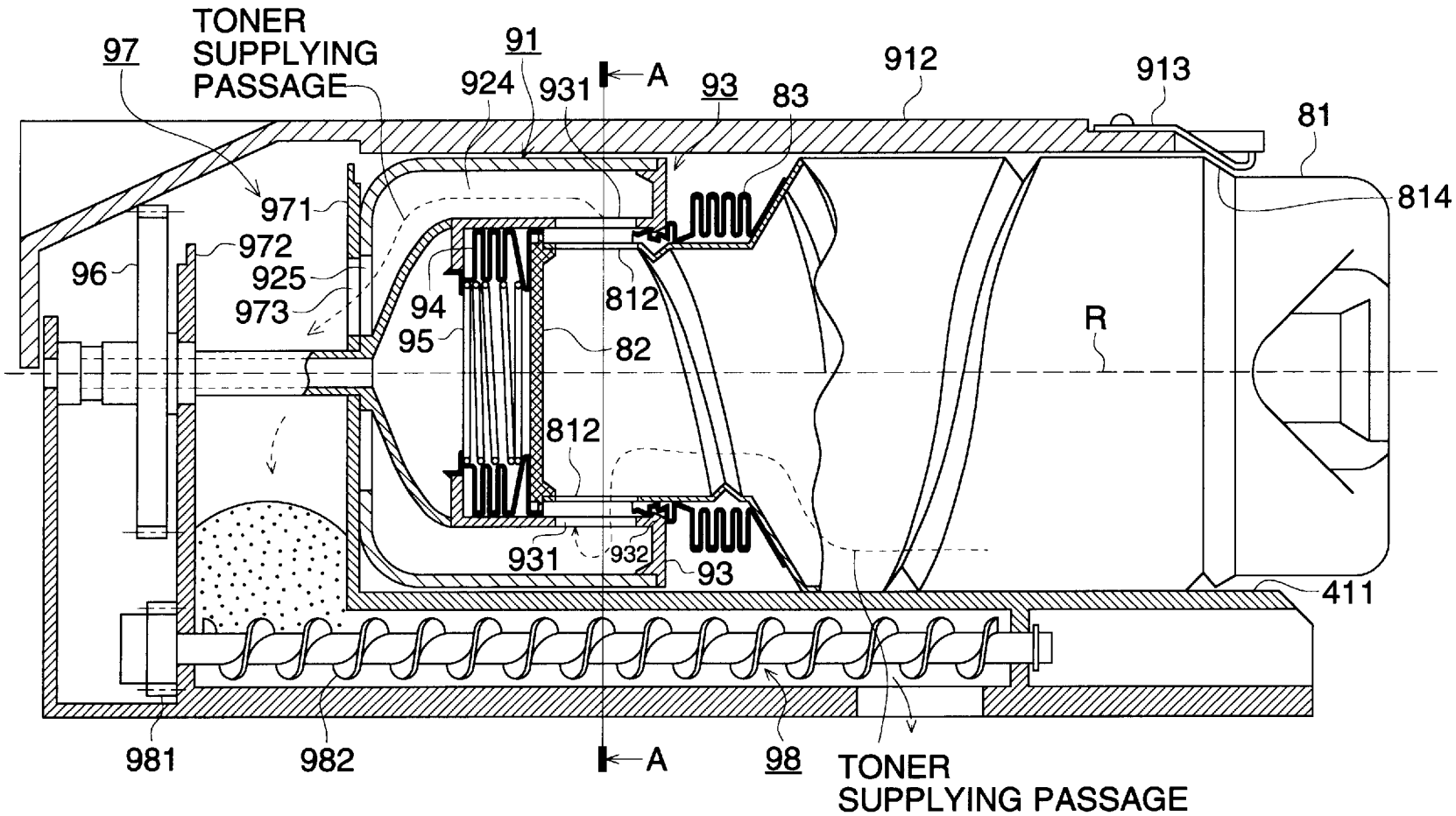
FIG. 13 is a cross-sectional view of the toner replenishing device with the toner container mounted to the container mounting portion.
Figure 14:
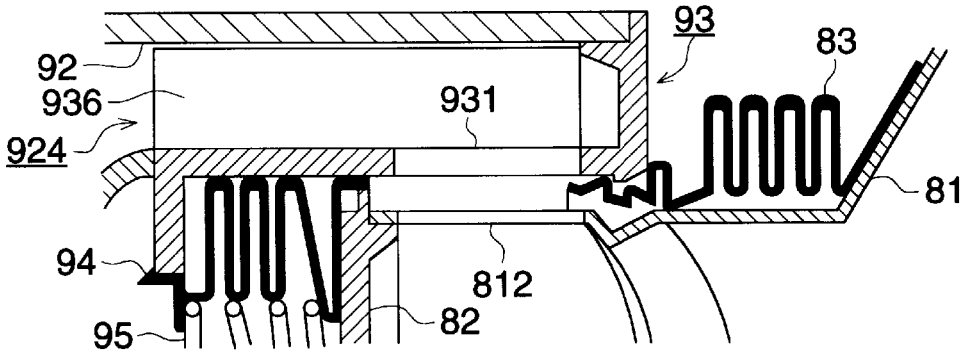
FIG. 14 is an enlarged partial cross-sectional view of the toner container and the container mounting portion.

FIG. 13 is a cross-sectional view of the toner replenishing device with the toner container 80 mounted to the container mounting portion 91, that is, a cross-sectional view showing the container 80, the container mounting portion 91, toner storing portion 97, and the toner feeding portion 98; FIG. 14 is an enlarged partial cross-sectional view of the toner container 80 and the container mounting portion 91; and FIG. 15 is a cross-sectional view through A—A of the toner container 80 and the container mounting portion 91 shown in FIG. 13.

The aforesaid container 80 is held and placed on the guiding platform 911 of the container mounting portion 91 to be moved to the left direction, with regard to the drawing; the bumping portion of the extreme end of the container 80 is made contact the right side of the aforesaid mounting-portion opening-or-closing cover 94.

Corresponding to successive moving of the container to the arrow mark direction, with regard to FIG. 12, in this process of moving of the container 80, the convex portion of the container opening-or-closing cover 83 bumps the entrance wall 934 of the aforesaid inner cylinder member 93, prevented from going forward; while the bellows portion of the container opening-or-closing cover 83 is compressed, the engaging portion 831 of the container opening-or-closing cover 83 disengages with the bumping portion 821 to be spaced apart; further, the fixed cover 82 presses the mounting-portion opening-or-closing cover 94. Due to this, the mounting-portion opening-or-closing cover 94 is compressed against the coil spring 95, thus the aforesaid opening (toner discharging opening) 931 is gradually opened to reach to the full-open state. This opening 931 in the full-open state comes to the same position as that of one of the openings 812 of the aforesaid container body 81, and that enables the discharging of the toner in the container body 81 to the opening 931 through the openings 812.

Figure 15:
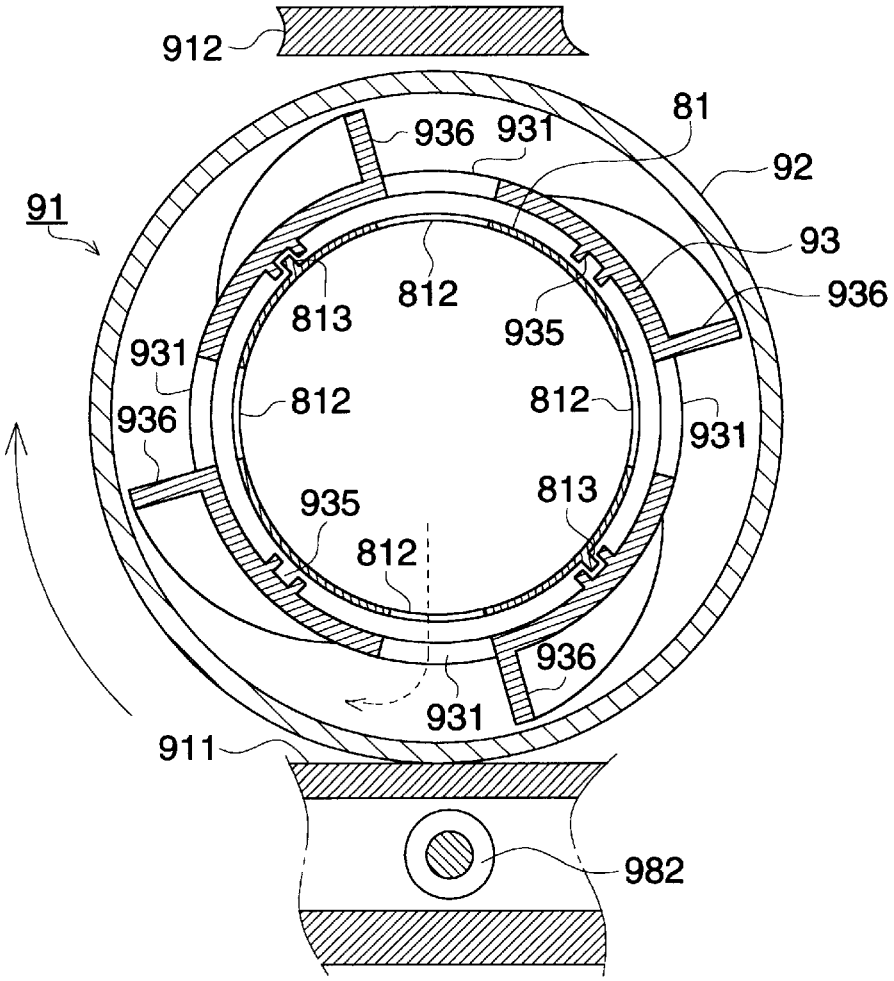
FIG. 15 is a cross-sectional view through A—A of the toner container and the container mounting portion shown in FIG. 13.

In reference to FIG. 15, the openings 812 are provided at four positions of the container body 81 through its wall, and protrusions 813 are provided at two positions on its periphery. Said protrusions 813 are fitted to some of the concaves 935 provided at four positions on the inner wall of the inner cylinder member 93. When the outer cylinder member 92 which makes a united portion with said inner cylinder member 93 is driven to rotate with the container rotating gear 96 linked to a drive source, the container body 81 linked to the concaves 935 of the inner cylinder member 93 is also driven to rotate together.

In the vicinity of each of the aforesaid openings 931 provided at the four positions on the inner cylinder 93 through its wall, each of paddles 936, which sum to four in all, is protruded. Said paddles 936 are skewed to the direction of the rotation axis R, and cause the toner conveyed through the toner feeding path 924 to be discharged smoothly. Said paddles (scooping-up portion) 936 scoop up the toner ejected from said openings 931 and convey it in the toner feeding path 924, and then discharge it through the toner replenishing opening 925.

The toner discharged from the toner replenishing opening 925 passes through the opening 973 in the upright wall 971 of the toner storing portion 97, and is received in the hopper.

The amount of the toner received in said toner storing portion 97 is detected by a photo-detector means, which is not shown in the drawing, and when the amount of the replenished toner reaches to a predetermined value, the driving of drive source is stopped to cease the replenishing of the toner from the toner storing portion 97.

Moreover, while aforesaid container 80 is rotated by the driving-force transmitting member 44 to replenish the toner to the toner storing portion 97, if the height of the toner heap in the toner storing portion 97 reaches to the same level as the toner heap in the container, continuing of the rotation of the container 80 will not cause to make any problem such as blocking of the toner, because the toner is not replenished in this state in spite of the continued rotation of the container 80.

The toner received in the hopper of the toner storing portion 97 is fed into the feeding screw 982 fixed to the feeding-screw gear 981 linked to the drive source, not shown in the drawing, conveyed through the toner feeding portion, and replenished to the aforesaid developing unit 20.

In reference to FIG. 12(*a*) and FIG. 13, above the container 80, container mounting portion 91, and the toner storing portion 97, a cover member 912 is arranged fixedly. At the entrance side of said cover member 912, an elastic member 913 for preventing slipping off of the container mounted is fixed and engages with the step portion 814 of the container body 81. Further, said elastic member 913 for preventing slipping off may be formed unitedly with a portion of the cover member 912. Furthermore, it is possible to make said elastic member 913 for preventing slipping off usable also as the member for preventing wrong mounting when the plural number of containers 80Y, 80M, 80C, and 80K are mounted to the prescribed container mounting portion 91Y, 91M, 91C, and 91K.

EFFECT OF THE INVENTION (1) The feature of the toner container according to one aspect of this invention is that it has an opening provided approximately parallelly to the center line of its cylindrical body on the periphery of the projected portion at approximately central part of its side, a scooping-up portion to scrape up the toner by rotating the container above the center axis of its rotation, and a toner guiding portion to guide the toner scooped up by the scooping-up portion to the opening.

First, because the opening is approximately parallel to the center line of the cylindrical body, the toner can be discharged by gravity with good efficiency. Further, the opening is provided on the periphery of the projected portion at approximately central part of the side of the container, and the toner is guided to the opening by the aforesaid scooping-up portion and toner guiding portion; thus the toner can be dropped from the position near the center axis of rotation of the container, that results in being capable of keeping a good amount of the toner stored in the toner storing portion. Furthermore, because the toner is conveyed up to the position of a certain degree of height, it is possible that the structure of the toner replenishing device is simplified.

(2) The toner container of this invention has a container opening-or-closing cover capable of expansion and contraction provided in the vicinity of its opening portion to open or close the opening. The opening-or-closing cover capable of expansion and contraction such as this has a good sealing function because the toner inside never leaks out as long as the end of the cover is firmly pressed while closing; the users are never smudged with the toner on the occasion of the mounting or dismounting of the container.

(3) The feature of the toner container according to another aspect of this invention is that it has a toner scooping-up portion to scrape up the toner by rotating the container above the center axis of its rotation, and a toner discharging portion which is provided inside the peripheral surface of the container, receives the toner scooped up by the aforesaid scooping-up portion and falling down, and guides the toner by the coil-shaped protrusion provided in the inner surface of the toner discharging portion to the aforesaid opening of the container to discharge. By making the container have such construction, it is not required that the toner replenishing device to be mounted with the container has a function to discharge the toner in the container, hence it is possible to simplify the structure of the apparatus. Further, the toner is scooped up above the center axis of rotation of the container to a certain position, is received as falling down, and then is guided by the coil-shaped protrusion to the opening of the container to be discharged; thus the toner can be dropped from the position near the center axis of rotation of the container, hence a good amount of the toner to be stored in the toner storing portion is secured. Furthermore, it is possible to make the efficiency of toner replenishing good.

(4) In accordance with this invention, the opening-or-closing cover of the container and that of the toner storing portion is opened or closed linked with the operation of mounting or dismounting of the container. By making the construction such as this, an additional operation to open or close each cover is not required and hence the troublesome operation is omitted.

(5) The third example of practice is an invention relating to a toner replenishing device which replenishes toner to a toner storing portion by rotating the toner container. The toner replenishing device is provided with a toner guiding means which guides the toner discharged from the opening provided at the peripheral surface of the toner container from a neighboring position of the periphery of the toner container to a position in the vicinity of the rotation axis of the toner container, the toner ejected therefrom to the toner storing portion. First, owing to placing the opening on the peripheral surface of the toner container, the toner is discharged with the best efficiency by the action of gravity upon rotating of the toner container, that enables discharging of the toner with no residue in the toner container. In addition, the structure of the toner container is simple, hence the cost for exchanging the container to be made several times for replenishing the toner to the image forming apparatus can be suppressed; this is effective for both the manufacturer and the users. Further, by providing such a toner guiding means as has the above-mentioned structure, though the toner container is adopted for the purpose of making the size of the apparatus smaller, the toner storing portion provided at the position beside the container, it is possible to secure a good amount of the toner stored in the toner in the toner storing portion; hence it is also possible to prevent such problems as lowering of the image quality and so forth, even during the exchanging of the toner container because of the lessening of the amount of the toner in the container.

(6) According to this example of practice, the opening-or-closing cover is provided at each of the openings, hence the toner leaking on the occasion of exchanging the toner container mounted can be prevented; further, by making the structure such that the cover is opened or closed on the occasions of the operation to mount or dismount the toner container, the operation to open or to close is ommitted, and hence time is also saved.

(7) According to this example of practice, a portion for transmitting driving force to rotate the toner container is provided at the toner guiding means, hence the space is effectively used, contributing to making the size of the apparatus smaller.

(8) Further, this example of practice has the feature that the scooping-up portion which scooping up the toner introduced through the opening of the toner guiding means above the axis of ratation of the toner container is provided in the toner feeding path of the toner guiding means; it is possible to cause the toner to fall down from a position higher than the rotation axis of the container to the toner storing portion, hence a good amount of the toner received and stored in the toner storing portion is secured. Furthermore, it is also possible to make the efficiency of stirring and replenishing of the toner good.

What is claimed is:

1. A toner container for use in an image forming apparatus having a toner receiving section, comprising:

a cylindrical container body in which toner is stored, the cylindrical container body having a toner discharging end and provided with a spiral rib provided on its inner circumferential surface so that toner is conveyed toward the toner discharging end by the spiral rib when the cylindrical container body is rotated, the cylindrical container body further having a cylindrical portion with a discharging port on the toner discharging end; and a sleeve member mounted around the cylindrical portion so that the discharging port is closed by the sleeve member, the sleeve member movable in the axial direction of the cylindrical portion so that when the toner container is attached to the toner receiving section of the image forming apparatus, the sleeve member is moved so as to open the toner discharging port.

2. The apparatus of claim 1, wherein the sleeve member is a retractable member so that the sleeve member returns so as to close the discharging port when the toner container is detached from the toner receiving section of the image forming apparatus.

3. The apparatus of claim 2, wherein the sleeve member is a bellows.

4. The apparatus of claim 1, further comprising:

a scooping member to scoop toner above the rotation axis of the cylindrical container body when the cylindrical container body is rotated; and a guide member to guide the scooped-up toner to the discharging port.

5. The apparatus of claim 1, wherein the cylindrical portion is provided with a spiral rib on its inner circumferential surface and a receiving port through which the scooped-up toner is dropped into the cylindrical portion, and wherein the toner is conveyed from the receiving port to the discharging port by the spiral rib when the cylindrical portion is rotated together with the cylindrical container body.

6. An apparatus for supplying toner to an image forming apparatus, comprising:

a toner container comprising a cylindrical container body in which toner is stored, the cylindrical container body having a toner discharging end and provided with a spiral rib provided on its inner circumferential surface so that toner is conveyed toward the toner discharging end by the spiral rib when the cylindrical container body is rotated, the cylindrical container body further having a cylindrical portion with a discharging port on the toner discharging end;

a sleeve member mounted around the cylindrical portion so that the discharging port is closed by the sleeve member, and a toner receiving section having a recess, wherein the sleeve member is movable in the axial direction of the cylindrical portion so that when the cylindrical portion is inserted into the recess, the sleeve member is moved so as to open the discharging port and the toner is supplied to the toner receiving section through the discharging port of the toner container and the recess.

7. The apparatus of claim 6, wherein the recess is a cylindrical recess and the recess is provided with a toner receiving port, and the toner is supplied to the toner receiving section through the toner receiving port.

8. The apparatus of claim 7, wherein the cylindrical recess is rotatable, on the outer circumferential surface of the cylindrical recess is provided a scooping member to scoop toner above the rotation axis of the cylindrical recess when the cylindrical recess is rotated with the cylindrical container body and the scooped-up toner is guided along the outer circumferential surface of the cylindrical recess.

9. The apparatus of claim 6, wherein the sleeve member is bellows and the bellows is retracted so as to open the discharging port when the cylindrical portion is inserted into the recess.

* * * * *